United States Patent [19]

Edwards et al.

[11] 4,273,049

[45] Jun. 16, 1981

[54] METHOD OF BLASTING A FIELD WITH ANFO AND TL-136

[75] Inventors: Donald W. Edwards, Provo, Utah; Paul R. Young; Thomas M. Zukovich, both of Palatine, Ill.

[73] Assignee: International Minerals & Chemical Corp., Terre Haute, Ind.

[21] Appl. No.: 86,913

[22] Filed: Oct. 22, 1979

[51] Int. Cl.[3] ..... F42D 3/00

[52] U.S. Cl. ..... 102/312; 149/47; 86/200

[58] Field of Search ..... 102/22, 23; 86/20 C; 149/47

[56] References Cited

U.S. PATENT DOCUMENTS

| | | | |
|---|---|---|---|
| 3,810,425 | 5/1974 | Post | 102/23 |
| 3,930,910 | 1/1976 | Post | 149/47 X |
| 3,943,820 | 3/1976 | Persson | 86/20 C |
| 4,028,153 | 6/1977 | Schneider | 102/23 X |
| 4,036,099 | 7/1977 | French | 102/23 X |
| 4,074,629 | 2/1978 | Colgate | 102/23 X |
| 4,161,142 | 7/1979 | Edwards et al. | 102/23 X |

*Primary Examiner*—Peter A. Nelson

*Attorney, Agent, or Firm*—Robert H. Dewey

[57] ABSTRACT

A method of drilling and blasting a field is disclosed. By use of a certain combination of blasting agents, it is possible to expand the bore hole pattern by 30 to 50%, thereby decreasing the number of bore holes per unit of area to be blasted.

4 Claims, No Drawings

METHOD OF BLASTING A FIELD WITH ANFO AND TL-136

BACKGROUND OF THE INVENTION

This invention relates to a method of blasting a field.

In a particular aspect, this invention relates to a method of blasting a field using an expanded bore hole pattern.

The ammonium nitrate-fuel oil mixture generally known as ANFO is in very widespread use for blasting, especially in large scale operations where an extensive field is to be blasted for easy removal, such as in strip mining operations. The bore holes, into which the ANFO is loaded, must be drilled rather close together, generally 2 ft.×2 ft. for each one inch of bore hole diameter, e.g. about 10–12 feet apart for 6 inch diameter holes in most structures, to provide satisfactory breakage of the geological formation where the blasting is conducted. A problem faced by ANFO users is water in the bore holes. It is a common experience that water collects in the holes before the drilling and loading of the holes can be completed. As a result, it is common practice to load a high explosive into the hole before adding the ANFO. The high explosive is selected to be unaffected by water and to be dense enough to sink in the water. However, high explosives are undesirable because they are more hazardous to handle and to transport than nitro-carbo-nitrates.

SUMMARY OF THE INVENTION

It is an object of this invention to provide a method of blasting a field.

It is another object of this invention to provide a method of drilling a field using an expanded bore hole pattern and blasting the field with a particular combination of blasting agents.

Other objects of this invention will be obvious to those skilled in the art from the disclosure herein.

It is the discovery of this invention to provide a method of blasting a field comprising the steps of (a) forming a drill pattern of bore holes, (b) successively delivering to the hole packaged blasting agent TL-136 and a bulk blasting agent mixture consisting essentially of ammonium nitrate, 86–90 parts, and 10–14 parts of a mixture of a hydrocarbon and a nitroalkane of 1–3 carbon atoms in a weight ratio of about 1:1 to about 1:4, respectively and having a minimum density of 1.0 g/cc, the ammonium nitrate consisting of about a 1:1 mixture of explosive grade prills and comminuted prills, (c) adding a booster and/or primer and an initiating device, and (d) detonating same.

DETAILED DISCUSSION

The discovery of this invention provides a method of blasting a field using a combination of packaged and bulk blasting agents which permit an expanded drill pattern compared with previous practice. According to the invention, a bore hole drill pattern is formed wherein the spacing and burden are greater than 2.5 feet per each inch of diameter of drill hole. The spacing and the burden distances are not necessarily the same. The bore hole is drilled to any depth desirable but preferably it is 5–15 inches in diameter. Into the hole there is first delivered a cartridged blasting agent designated TL-136, which is further described hereinafter. It is water resistant as packaged and is heavier than water, so it will function in a wet hole. An amount of TL-136 is loaded into the hole sufficient to exceed the water level, either actual or anticipated. A booster and/or primer and an initiating device are then added. Then bulk ammonium nitrate, a hydrocarbon and a nitroalkane are mixed and off-loaded to fill the hole to any desired level and the remainder of the bore holes are similarly filled; the initiating devices are then detonated and the drilled field is blasted. Additional boosters and/or primers can be used, e.g., in especially deep holes, as is known in the art. Any of the boosters, primers, initiating devices, e.g. blasting caps, etc. known in the art can be used in the practice of this invention.

The above method permits considerable savings in drilling costs and total costs for explosives, boosters, primers and initiating devices.

Blasting agent TL-136 is commercially available. It comprises ammonium nitrate in an amount of about 86% by weight mixed with about 10% by weight of a fuel composition and about 4% of a densifying agent therefor, such as bentonite, which also increases the density of the composition. It is understood that these quantities are the preferred quantities. It is not intended they be precise and considerable variation therefrom is permissible without adversely affecting the sensitivity. For example, the fuel may vary from about 8 to about 14%, and the densifying agent may vary from about 2 to about 8%, the remainder being ammonium nitrate.

The fuel component of the blasting agent comprises a mixture of a nitroalkane of 1 to 3 carbon atoms and a hydrocarbon, e.g. fuel oil, in a ratio of from about 1:1 by weight to about 4:1. The nitroalkane can be nitromethane, nitroethane, or preferably nitropropane, or mixtures thereof. Either 1-nitropropane or 2-nitropropane may be used with equally good results. When nitromethane is used as the nitroalkane, the mixture is sufficiently shock sensitive to be classified as an explosive by Department of Transportation tests. When nitroalkanes of 2–3 carbon atoms are used, the sensitivity is that of nitro-carbo-nitrates.

The hydrocarbon useful in the practice of this invention can be any hydrocarbon known in the art. Preferably it is an aliphatic hydrocarbon such as fuel oil, diesel fuel and the like. It is not intended that the invention be limited as to any type of hydrocarbon.

The ammonium nitrate used in the practice of this invention is a mixture of low density, explosive grade ammonium nitrate prills, as known in the art, and comminuted prills. The comminuted ammonium nitrate can be used in an amount of from 20% to 80% of the total, preferably about 50% by weight. A typical screen analysis of the latter is as follows:

| | |
|---|---|
| +18 | 58.75% |
| +35 | 16.25% |
| +60 | 12.5% |
| +80 | 3.75% |
| +120 | 3.75% |
| +230 | 3.75% |
| −230 | 1.25% |

The bentonite used in the practice of this invention can be either the Southern or the Western type in an amount of about 2 to about 8% of the total composition, preferably about 4%. Preferably, the bentonite is comminuted, e.g. about −200 mesh. The bentonite is primarily useful in preventing the liquid fuel component from draining off the ammonium nitrate solids and puddling in the bottom of the bag. In the absence of bentonite, this puddling develops rather rapidly on standing and the mixture becomes insensitive, failing to detonate when initiation is attempted. The bentonite has the added advantages contributing to a higher density mixture and tending to stabilize it to shock without unduly desensitizing it.

The composition of this invention is readily prepared by mixing the ingredients in a conventional manner and discharging the mixture into suitable containers, e.g. plastic bags.

The above blasting agent is preferably packaged in a nylon bag of from 4 to 8 inches in diameter. The nylon is at least 1.25 mil thickness, there being no upper limit as to thickness. However, 1 mil thickness nylon film is relatively easily torn and punctured and because heavier gauge nylon is relatively expensive, it is preferred to employ the nylon bag in conjunction with polyethylene. The nylon can be laminated to the polyethylene or it can merely be formed into a bag heat sealed at one end and inserted in a polyethylene bag, also heat sealed at one end. Such a packaging system wherein the nylon is of from 1 to 2 mil and the polyethylene is from 4 to 5 mil has proven very successful.

The bulk blasting agent useful in the practice of this invention is essentially the same as TL-136 except that it contains no thickening agent. It must, therefore, be mixed and used reasonably promptly before the hydrocarbon and nitroalkane drain away from the ammonium nitrate causing the mixture to exhibit a reduced sensitiveness.

The preferred method of using the bulk blasting agent of this invention is to mix the nitroalkane and hydrocarbon in a ratio of about 1:1 to about 4:1 and separately transport this mixture and the ammonium nitrate mixture to the blasting field. To load the bore hole, the ammonium nitrate is discharged from a hopper into a mixing auger of known design and the nitroalkane and hydrocarbon mixture is then metered into the auger in an amount to provide about 8–14% by weight based on the ammonium nitrate. As the mixture exits from the auger, it is discharged directly into the bore hole to any desired level. The TL-136 cartridged blasting agent was, of course, previously placed in the bore hole.

The term spacing as used herein is intended to have the same meaning as known in the art, i.e., the distance between any two adjacent holes of a row on a straight line. The term burden as used in the art means the distance between any two adjacent holes on straight line perpendicular to the spacing row.

The invention will be better understood with reference to the following examples. It is understood that the examples are intended only to illustrate the invention and it is not intended that it be limited thereby.

EXAMPLE 1

In accordance with the previous practice, a field was drilled with 100 holes, on a twelve feet spacing and twelve feet burden. Previous experience with the type of geological formation to be blasted had shown that such a distribution was the maximum which would give satisfactory break-up. The holes were sixty-nine feet deep. In the bottom of each hole was placed five pounds of high explosive, partly in case of water in the hole and also to insure good break-up. On to that was loaded a primer and an initiator, then 192 pounds of conventional nitro-carbo-nitrate and 533.4 pounds of conventional ammonium nitrate-fuel oil mixture (94.6:5.4). The field was then blasted.

In accordance with the method of this invention, a field adjacent to the one described above, and of the same geological formation, was drilled on a pattern of fifteen feet spacing and fifteen feet burden to a depth of sixtynine feet. The increase in drill pattern was 56%. The number of holes required to cover the same area as before was 64 compared with 100. Each hole was loaded with an average of 240 pounds of TL-136 in case of water in the bottom of the hole (thus substituting for the high explosive). A 1:1 mixture of comminuted ammonium nitrate and prilled ammonium nitrate was delivered to an auger from a hopper and a mixture of diesel fuel oil and nitropropane in 1:1 ratio by weight was added in a proportion to provide a ratio of one part of the mixture to nine parts ammonium nitrate. The density was 1.1 g/cc. The mixture was discharged directly into each bore hole until approximately 656.5 pounds per hole had been added. A primer and an electric blasting cap were added to each hole and finally the field was blasted.

Economic analysis showed that the method of the present invention reduced total costs to 75% of that of the previous method, thus providing a savings of 25%.

We claim:

1. A method of blasting a field comprising the steps of (a) forming a drill pattern of bore holes, (b) successively delivering to each hole blasting agent TL-136 and a bulk blasting agent mixture consisting essentially of ammonium nitrate 86–90 parts by weight and 10–14 parts by weight of a hydrocarbon and a nitroalkane of 1–3 carbon atoms in a ratio of about 1:1:4 respectively and having a minimum density of 1.0 g/cc, the ammonium nitrate consisting of about a 1:1 mixture of explosive grade prills and comminuted prills, (c) adding a booster and/or primer and initiating device and (d) detonating same.

2. The method of claim 1 wherein the nitroalkane of the bulk blasting agent is nitropropane.

3. The method of claim 1 wherein the nitroalkane of the bulk blasting agent is nitroethane.

4. The method of claim 1 wherein the nitroalkane of the bulk blasting agent is nitromethane.

* * * * *